United States Patent [19]

Stephens

[11] Patent Number: 4,781,042

[45] Date of Patent: Nov. 1, 1988

[54] AUTOMOBILE CHILD PREVENTION LOCKS

[76] Inventor: Rick J. Stephens, 1318 Oak Way, Glenwood Springs, Colo. 81601

[21] Appl. No.: 103,609

[22] Filed: Oct. 2, 1987

[51] Int. Cl.[4] ..... E05B 73/00

[52] U.S. Cl. ..... 70/14; 292/288

[58] Field of Search ..... 292/288, DIG. 13, 289; 70/14, 210, 211, 364 R, 19 B, 199

[56] References Cited

U.S. PATENT DOCUMENTS

| | | | |
|---|---|---|---|
| 1,850,602 | 3/1932 | Pineo | 70/211 |
| 2,165,775 | 7/1939 | Winslow | 70/210 |
| 2,537,380 | 1/1951 | Travis | 292/288 |
| 2,552,294 | 5/1951 | Partnignani | 70/364 R |
| 2,677,261 | 5/1954 | Jacobi | 70/210 |
| 3,416,827 | 12/1968 | Cole | 292/288 |
| 4,116,514 | 9/1978 | Lawrence | 16/380 |
| 4,459,832 | 7/1984 | Arrea | 90/14 |
| 4,691,541 | 9/1987 | McQuade | 292/DIG. 13 |

FOREIGN PATENT DOCUMENTS

| | | | |
|---|---|---|---|
| 2653472 | 6/1977 | Fed. Rep. of Germany | 292/288 |
| 705900 | 3/1954 | United Kingdom | 292/288 |

*Primary Examiner*—Robert L. Wolfe

*Attorney, Agent, or Firm*—Jerry T. Kearns

[57] ABSTRACT

Automobile child prevention locks are provided to prevent children from operating the door actuating lever and the window operating lever from the interior of the vehicle. The door actuating handle lock consists of two flat plates hinged together. A lock mechanism allows the plates to be locked together in parallel overlying relation. When placed over a conventional U-shaped door actuating lever, an elongated finger on one of the plates prevents the door lever from being moved. A window operating lever lock has a hollow barrel which is mounted in the door panel. A cylindrical locking member, which has an L-shaped overhanging arm for engagement with the window operating lever, is lockably received within the hollow barrel. By use of these hooks, both the doors and windows of an automobile may be secured from opening by children within the vehicle.

1 Claim, 1 Drawing Sheet

AUTOMOBILE CHILD PREVENTION LOCKS

BACKGROUND OF THE INVENTION

1. Field of the Invention

The present invention relates to automobile child prevention locks, and more particularly pertains to new and improved locks for preventing the doors and windows of a vehicle from being opened by children within the vehicle. When young children are riding within a vehicle, it is often dangerous for them to open the doors or windows of the vehicle at an inopportune time. Also, it is sometimes desired to keep children restrained within the interior of the vehicle while the parents are attending to an errand. The conventional door locks and window operating mechanisms allow children within the vehicle to open the doors and windows at will. Currently, people desiring to keep the children from opening the windows and doors from the interior of the vehicle resort to such extremes as removing the door and window operating handles. The present invention avoids the necessity of these extreme measures by providing easily actuatable locks for both the window operating lever and the door actuating handle.

2. Description of the Prior Art

Various types of door and window locks are known in the prior art. A typical example of such a locking mechanism is to be found in U.S. Pat. No. 2,578,547, which issued to H. Hilger on Dec. 11, 1951. This patent discloses a foil for attachment over the door handle on the interior of an automobile. The device includes a shroud which encloses the door handle which is secured by a screw mechanism. U.S. Pat. No. 3,660,996, which issued to A. Syvertson on May 9, 1972, discloses a locking device for a doorknob lock. This device includes a base which is secured around a doorknob by screws extending into the door. A cover is pivotally connected by a hinge to the base and is movable between open and closed positions. In the closed position the doorknob is completely surrounded. A locking mechanism is provided to maintain the cover in a closed and locked position. U.S. Pat. No. 3,710,606, which issued to E. Prince on Jan. 16, 1973, discloses a device for locking a hand operated shift of the type in which a movable shift stick is located on a central panel in the driver's compartment between the two seats of an automobile. The device includes a cylindrical member which fits over the handle portion of the stick shift at a location to enclose a movable release button. The release button must be depressed in order to move the stick shift from one gear position to another. The locking device includes an opening or slot in the tubular member which covers the handle part and it extends on the other side of the stick. A top portion bounding the slot has a lock shank receiving opening so that the lock shank may block the slot to keep the locking cylinder from being dislodged from a position blocking the movement of the release button. In this manner unauthorized operation of the stick shift is prevented. U.S. Pat. No. 3,837,191, which issued to L. Soiderer on Sept. 24, 1974, discloses a safety lock device for windows that can be assembled with existing household windows having sliding upper and lower sashes and a latch mounted on the sashes. The device consists of a hollow member secured to one sash so as to overlie the latch and permit access to the latch only through a side opening in the hollow member and a cover or slide member telescopically mounted on the hollow member for movement to a position blocking the latch access opening. Provision is made for locking the slide in this position. U.S. Pat. No. 4,064,721, which issued to R. Morgan on Dec. 27, 1977, discloses a security lock for dead-bolt door locks. This device includes a shroud that encompasses and grips the dead-bolt actuator at the inside of the door, and is rotatably mounted in a base secured to the inner face of the door, with a handle portion on the shroud exposed to enable the shroud, and hence the dead-bolt actuator, to be manually turned. A spring biased security bolt slidably mounted in the base engages a cylindrical side surface of the shroud and snaps into a keeper recess in that surface when the shroud is turned to the position at which the dead-bolt is in its projected door-locking position. This device thus prevents the dead-bolt actuator, or tumbler lock, at the inside of the door from being rotated to a position retracting the dead-bolt.

While the above mentioned devices are suited for their intended usage, none of these devices is suitable for locking the door actuating handle and window operating lever against manipulation by occupants within a vehicle. Further, none of these devices provide locking mechanisms which can be readily attached and removed from the door operating handle and window operating lever within the interior of a vehicle. Inasmuch as the art is relatively crowded with respect to these various types of locking devices, it can be appreciated that there is a continuing need for and interest in improvements to automobile child prevention locks, and in this respect, the present invention addresses this need and interest.

SUMMARY OF THE INVENTION

In view of the foregoing disadvantages inherent in the known types of locking mechanisms now present in the prior art, the present invention provides improved automobile child prevention locks. As such, the general purpose of the present invention, which will be described subsequently in greater detail, is to provide new and improved automobile child prevention locks which have all the advantages of the prior art locking mechanisms and none of the disadvantages.

To attain this, representative embodiments of the concepts of the present invention are illustrated in the drawings and make use of a first locking mechanism for preventing actuation of the door actuating handle and a second locking mechanism for preventing operation of the window operating lever. The first door handle locking mechanism utilizes a pair of flat plates connected by a hinge. A locking mechanism is provided for locking the first and second plates together in parallel overlying relation. One of the plates is provided with an elongated finger, which in use extends parallel to the door panel of a vehicle door. This finger prevents the door operating handle from being pulled away from the door. The window locking mechanism includes a first cylindrical barrel element which is mounted into the door panel of the vehicle. A cylindrical plug member is insertable into the barrel and lockable therein. The cylindrical plug has a radially extending L-shaped arm adapted to be received over the window operating lever. The concurrent use of the door operating handle locking mechanism and the window operating lever locking mechanism provide a system for restraining a child within a vehicle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved automobile child prevention locks which have all the advantages of the prior art automobile child prevention locks and none of the disadvantages.

It is another object of the present invention to provide new and improved automobile child prevention locks which may be easily and efficiently manufactured and marketed.

It is a further object of the present invention to provide new and improved automobile child prevention locks which are of a durable and reliable construction.

An even further object of the present invention is to provide new and improved automobile child prevention locks which are susceptible of a low cost of manufacture with regard to both materials and labor, and which accordingly are then susceptible of low prices of sale to the consuming public, thereby making such automobile child prevention locks economically available to the buying public.

Still yet another object of the present invention is to provide new and improved automobile child prevention locks which provide in the apparatuses and methods of the prior art some of the advantages thereof, while simultaneously overcoming some of the disadvantages normally associated therewith.

Still another object of the present invention is to provide new and improved automobile child prevention locks which comprise a system for restraining a child within a vehicle.

Yet another object of the present invention is to provide new and improved automobile child prevention locks which prevent the door actuating handle and window operating lever from being actuated from within a vehicle.

Even still another object of the present invention is to provide new and improved automobile child prevention locks which may be quickly locked and unlocked.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
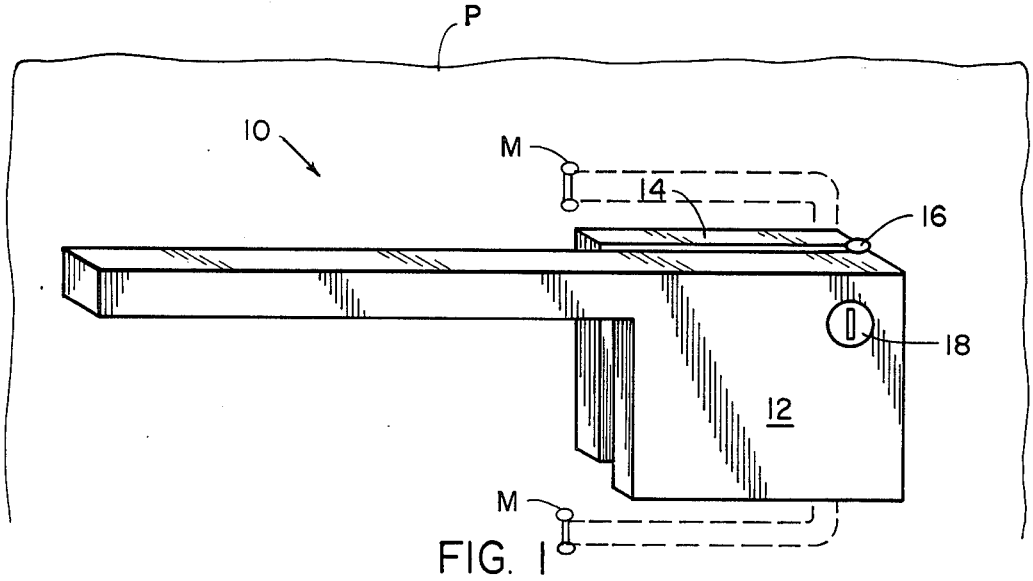
FIG. 1 is a perspective view of the door actuating handle locking mechanism of the present invention.

With reference now to the drawings, and in particular to FIG. 1 thereof, a new and improved door actuating handle locking mechanism embodying the principles and concepts of the present invention and generally designated by the reference numeral 10 will be described.

More specifically, it will be noted that the first embodiment 10 of the invention includes a first plate member 12 pivotally connected to second plate member 14 by a hinge 16. A locking cylinder 18 is provided for locking the plate members 12 and 14 together. The first plate member 12 has an elongated finger portion 20, formed integrally therewith.

Figure 2:
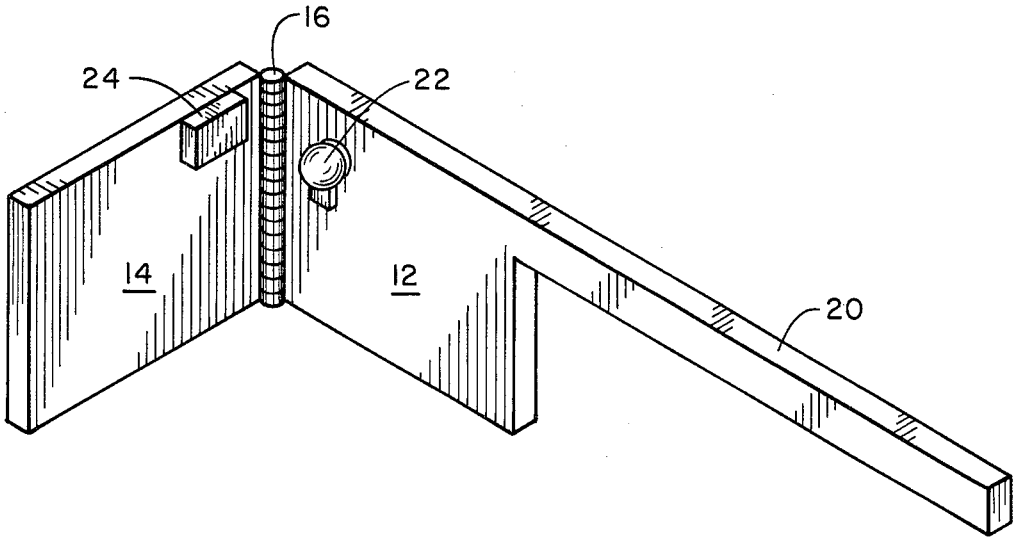
FIG. 2 is a perspective view of the door actuating handle locking mechanism of the present invention pivoted to an open position.

With reference now to FIG. 2, it may be seen that the locking cylinder 18 communicates with a locking mechanism 22. The locking mechanism 22 on the first plate member 12 has a latch adapted to be received in a mating lock portion 24 formed on the second plate member 14. By pivoting the plate members 12 and 14 to a closed position in which the plate members 12 and 14 are parallel and overlying, they may be locked together via lock mechanisms 18, 22 and 24.

Figure 3:
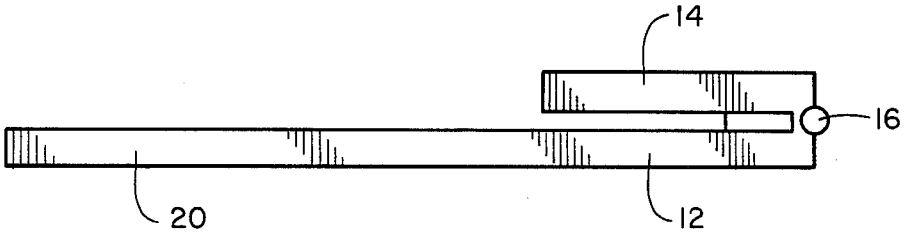
FIG. 3 is a top plan view of the door actuating handle locking mechanism of the present invention pivoted to a closed position.

With reference now to FIG. 3, the closed and locked position of the plate members 12 and 14 may now be understood.

Figure 4:
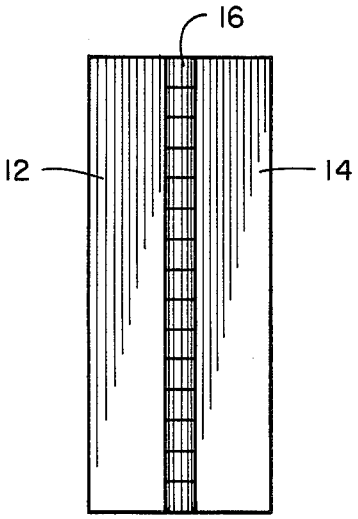
FIG. 4 is a side plan view of the door actuating handle locking mechanism of the present invention pivoted to a closed position.

FIG. 4 is a side view illustrating the plate members 12 and 14 in the closed and locked position.

With reference now to FIGS. 1 and 2, the method of use of the door operating handle locking mechanism 10 of the present invention will now be described. With the locking mechanism 10 in the unlocked open position illustrated in FIG. 2, the second plate member 14 is slipped behind a conventional U-shaped door operating handle H, which is pivotally mounted at ends M to a door panel P of a vehicle. The first plate member 12 is then pivoted over the top of the conventional U-shaped door operating handle, thus sandwiching the door operating handle between the plate members 12 and 14. By use of a key in the lock cylinder 18, the latch 22 on the first plate member 12 is locked through the central open portion of the U-shaped door actuating handle, into engagement with the latch mechanism 24 on the second plate member 14. The plate members 12 and 14 will now be in the position illustrated in FIG. 1. In this position, the conventional U-shaped door actuating handle H is sandwiched between the plate members 12 and 14, and the elongated finger 20 on the first plate member 12 extends parallel to the door panel P of the vehicle. Due to the presence of the second plate member 14 beneath the door actuating handle H, it is impossible for a child to insert his fingers beneath the door actuating handle. Due to the extent of the elongated finger 20, it is also impossible to pivot the door actuating handle outwardly away from the door panel P. This prevents the door from being opened. It may be understood that when installed on a door on the left side of a vehicle, the elongated finger 20 will be disposed at the top portion of the locking mechanism 10 as illustrated in FIG. 1. Also, it should be understood that by merely inverting the locking mechanism 10, it may be utilized on doors of the right hand side of the vehicle. When in use on right hand vehicle doors, the elongated finger 20 will be disposed along the bottom portion of the device in a position inverted relative to that shown in FIG. 1. When it is desired to remove the locking mechanism 10 of the present invention, it is merely necessary to unlock the plates 12 and 14 via a conventional key type mechanism at 18 and slip the plate member 14 from beneath the conventional door actuating handle H.

Figure 5:
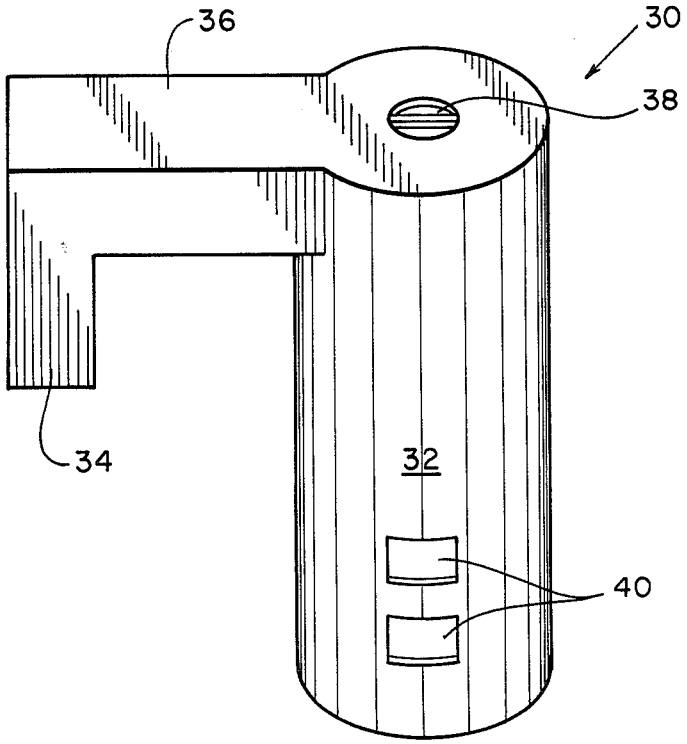
FIG. 5 is a perspective view of the window operating lever locking plug of the present invention.

With reference now to FIG. 5, a window operating lever locking mechanism 30 according to the present invention will now be described. More specifically, it will be noted that the window operating lever locking mechanism 30 of the invention includes a cylindrical locking plug 32 having a radially extending L-shaped locking arm 34, 36. The cylindrical locking plug 32 is provided with a central, conventional key operated locking mechanism 38. By inserting a key into the mechanism 38 and rotating the key, a pair of projections 40, may be caused to radially extend or retract relative to the cylindrical locking plug 32.

Figure 6:
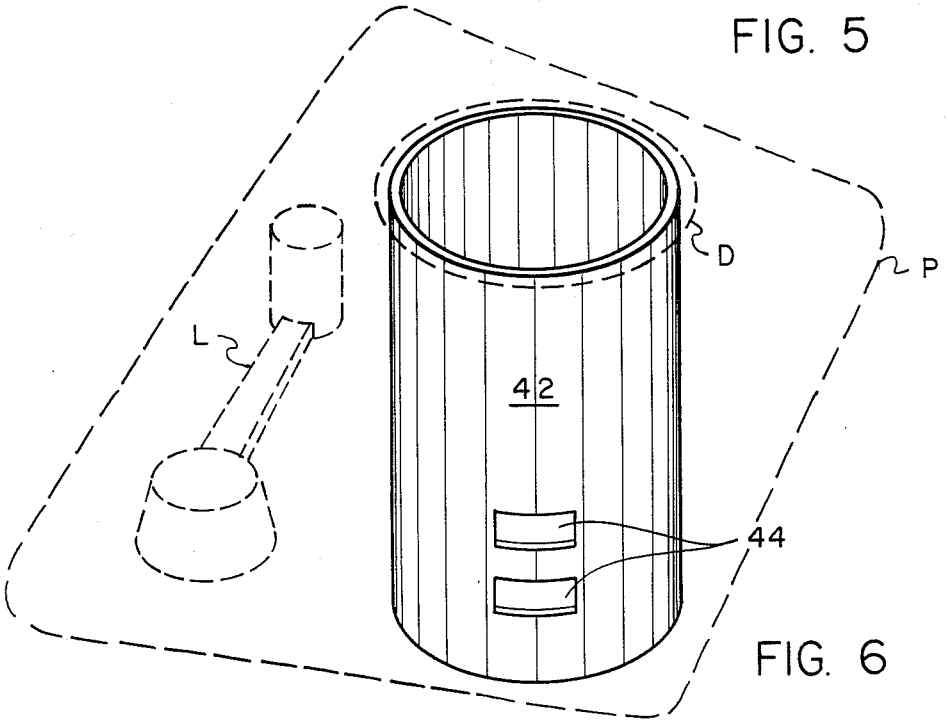
FIG. 6 is a perspective view of the locking barrel of the window operating lever locking mechanism of the present invention.

FIG. 6 illustrates a hollow cylindrical locking barrel 42, designed to lockably receive the cylindrical locking plug 32. As may be easily understood, the cylindrical locking plug 32 may be inserted into the locking barrel 42, a key turned in the locking cylinder 38, thus extending the locking projections 40 into engagement with recesses 44 formed in the locking barrel 42. It will now be understood that the cylindrical locking plug 32 and hollow cylindrical locking barrel 42 may be locked together in this fashion.

Figure 7:
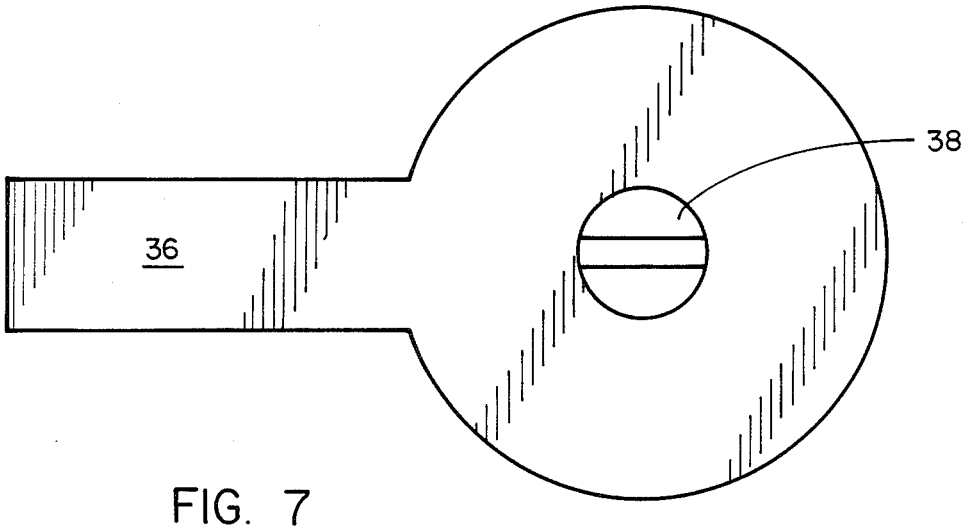
FIG. 7 is a top plan view of the window operating lever locking plug of the present invention.

FIG. 7 illustrates a top plan view of the cylindrical locking plug 32. It will again be noted that the L-shaped arm 34,36 projects radially from the cylindrical locking plug 32.

Figure 8:
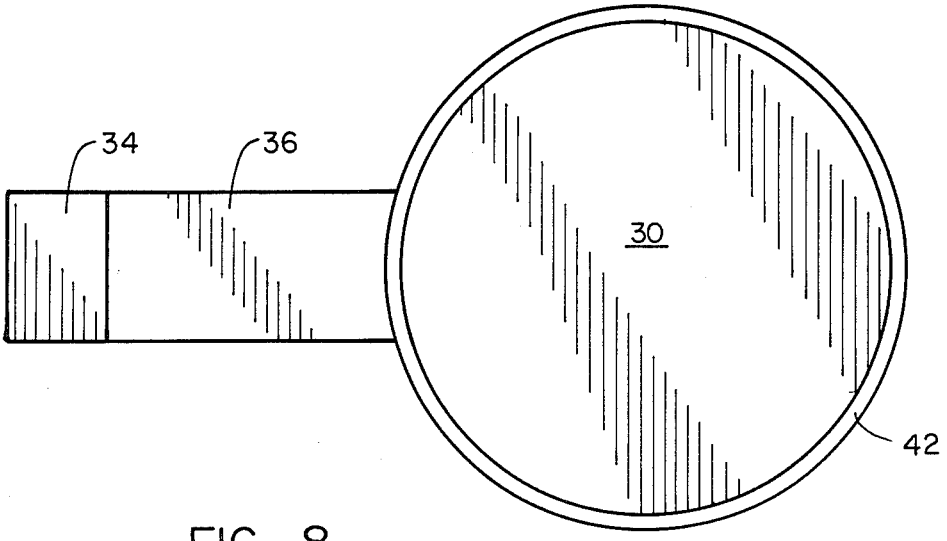
FIG. 8 is a bottom plan view of the window operating lever locking plug installed within the locking barrel.

FIG. 8 illustrates a bottom plan view of the cylindrical locking plug 32 received within the hollow cylindrical locking barrel 42. Again, the radially extending L-shaped arm 34 and 36 is apparent.

The manner of usage of the window operating lever locking mechanism 30 of the present invention, which will be best understood with reference to FIGS. 5 and 6, will now be described. The hollow cylindrical locking barrel 42 is mounted firmly within the door panel P, adjacent the window operating lever L, of a vehicle. This may be achieved by drilling a hole D in the door panel and inserting the locking barrel 42 into the hole D. In this position, the locking barrel 42 is situated perpendicular to the plane of the vehicle door panel P. The locking barrel 42 may be secured in this position via conventional fastening means, sush as bolts, rivets or by welding. The end of the locking barrel 42 will be disposed flush with the door panel P of the vehicle. A radially outwardly extending peripheral flange may be provided on the hollow locking barrel 42 for engagement with the interior door panel, although this is not strictly necessary. With the locking barrel 42 thus mounted in the door panel of a vehicle, the cylindrical locking plug 32 may be inserted therein, and lockably retained thereto, by manipulation of a key in the locking cylinder 38. This results, as previously described, in the radial extension of a pair of projections 40 into engagement with recesses 44 of the locking barrel 42. By positioning the L-shaped arm 36, 34 over the window operating lever L, it will now be readily understood that the window operating lever is restrained from rotation, thus preventing the opening of the window. The window operating lever locking mechanism 30 of the present invention may of course at any time be easily removed by merely unlocking the cylindrical locking plug 32 and removing it from the locking barrel 42.

As will now be understood, the concurrent use of the door operating handle locking mechanism 10 and window operating lever locking mechanism 30 of the present invention provides a child restraint system for keeping a child within the interior of a vehicle. This is desirable for purposes of retaining the children within the vehicle while the parents are on an errand, and also for retaining the children within the vehicle while traveling on the roadways. As is obvious from the above description, the window may be locked in a partially opened position to provide adequate ventilation, while at the same time preventing the children from climbing through the window.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. For use in a vehicle having an interior, at least one door, an interior door panel on the door, a U-shaped door actuating handle pivotally mounted on the door panel, a window operating lever rotatably mounted on the door panel;

a new and improved automobile child prevention lock system for preventing the operation of the door actuating handle and window operating lever of the vehicle from the interior, comprising:

first lock means for attachment to the U-shaped vehicle door actuating handle, for preventing operation of the handle;

said first lock means having first and second planar plate members connected by a hinge for movement between an open position and a closed position in which said first and second plate members extend in parallel overlying relation;

an elongated finger portion on said second plate member;, means on said first and second plate members for locking said plate members in a closed parallel overlying position;

second lock means for attachment to the window operating lever, for preventing operation of said lever;

said second lock means having a hollow cylindrical barrel mounted within the door panel of the vehicle, adjacent the window operating lever, said barrel extending perpendicularly to the plane of the door panel;

a pair of recesses formed in said hollow cylindrical barrel;

a cylindrical plug dimensioned for reception within said hollow cylindrical barrel;

a radially extending L-shaped arm on said cylindrical plug adapted for receipt over the window operating lever;

a centrally disposed key operated lock cylinder in said cylindrical plug;

and a pair of radially extendable projections actuated by said key operated lock cylinder and adapted for receipt in said recesses of said hollow cylindrical barrel.

* * * * *